United States Patent [19]

Turner

[11] 3,978,628

[45] Sept. 7, 1976

[54] CONSTRUCTIONAL UNITS FOR STEPPED STRUCTURES

[76] Inventor: Jack Turner, High Rise, Highgate Lane, Whitworth, New Rochdale, Lancashire, England

[22] Filed: Aug. 14, 1975

[21] Appl. No.: 604,817

Related U.S. Application Data

[63] Continuation of Ser. No. 440,077, Feb. 6, 1974, abandoned.

[30] Foreign Application Priority Data

Feb. 20, 1973 United Kingdom ..... 8221/73

[52] U.S. Cl. ..... 52/188; 52/183; 52/190

[51] Int. Cl.[2] ..... E04F 11/00

[58] Field of Search ..... 52/182, 183, 184, 185, 52/188, 190, 191

[56] References Cited

UNITED STATES PATENTS

| | | | |
|---|---|---|---|
| 1,385,209 | 7/1921 | Hall | 52/191 |
| 1,660,392 | 2/1928 | Norberg | 52/191 |
| 1,713,582 | 5/1929 | Wilson | 52/191 |
| 3,470,664 | 10/1969 | Whitehead | 52/183 |
| 3,608,256 | 9/1971 | Jeffery's | 52/182 |
| 3,744,198 | 7/1973 | Boalssy | 52/184 |
| 3,755,981 | 9/1973 | West | 52/184 |
| 3,789,556 | 2/1974 | Skinner | 52/303 |
| 3,897,665 | 8/1975 | Yokomori | 52/188 |

FOREIGN PATENTS OR APPLICATIONS

| | | | |
|---|---|---|---|
| 494,155 | 8/1950 | Belgium | 52/182 |
| 595,471 | 6/1959 | Italy | 52/190 |
| 289,308 | 7/1953 | Switzerland | 52/189 |

*Primary Examiner*—Ernest R. Purser
*Assistant Examiner*—Henry Raduazo
*Attorney, Agent, or Firm*—James E. Nilles

[57] ABSTRACT

A constructional element has an L-shaped body of molded metal or synthetic plastics material. The two arms of the body are provided with inclined stepped surfaces so that two adjacent elements can be locked together in one of a number of different relative positions. In this way a plurality of the elements can be used to build-up a staircase or variable height and extent.

6 Claims, 8 Drawing Figures

CONSTRUCTIONAL UNITS FOR STEPPED STRUCTURES

Ser. No. 440,077 6, now

The present invention relates to constructional elements which can be assembled to form a stepped structure. The present application is a continuation of my U.S. application Ser. No. 440,077 filed February 6, 1974, now abandoned.

At the present time stepped structures such as staircases are made almost wholly of wood. The staircase requirements are generally such that only the best wood can be used as boards having a minimum required width for the go portions of the staircase. Such boards are becoming increasingly difficult to get and accordingly are becoming increasingly expensive.

More specifically, to be satisfactory, a staircase must comply with certain restrictive, and in some cases, complicating requirements. Thus, for safety reasons, the pitch of the staircase must not be greater than a certain amount and the width of the tread portions must not be less than a certain amount. The requirement regarding the width of the tread portions means that the timber for these portions must be taken from the central and least plentiful part of a tree trunk. Therefore, in addition to the scarcity problem which is affecting timber generally, there is also the problem that timber for staircases has always been less plentiful than timber suitable for other purposes.

Furthermore, it would be advantageous if the problem of transporting finished staircases from factory to building site, the problem of obtaining the necessary skilled labor for assembling such staircases and the problem of keeping a large enough stock of complete staircases to fit a variety of different types of houses could also be met.

All of these foregoing problems were solved by devising a staircase comprising a number of constituent elements each of which provides a step of the staircase, is adjustable in relation to the other steps, can be assembled with the other constituent elements by relatively unskilled labor and can be molded from one of a number of readily available materials as a result of which it is light and relatively inexpensive to make.

According to the present invention, there is provided a constructional element, which can be assembled with one or more similar constructional elements to form a stepped structure, comprising a substantially L-shaped body wherein one arm of the 'L' is provided with an inclined surface at or near its extremity and the other arm of the 'L' is provided with a similarly inclined surface at or near its extremity, the inclined surfaces being of an interlocking nature.

The constructional element is advantageously molded. A preferred molding material is solid or foamed synthetic plastics material for example, polystyrene or polyvinylchloride. The element may alternatively be molded from metal such as aluminum and zinc alloys.

In one advantageous embodiment of the invention, each of the inclines surfaces is stepped and movement of the two inclined surface relative to each other enables the height and length of a stepped structure to be varied.

Preferably that arm of the 'L' which constitutes a go portion of the element is formed with anti-slip tread pattern.

In another advantageous form of embodiment each element is formed with lateral projections for insertion into stringers to produce a finished staircase. Each element is preferably also provided with screw-holes into which screws may be screwed to fix the stringer securely to the element.

In order that the present invention may be more fully understood, two embodiments of the invention will now be described by way of example with reference to the accompanying drawing in which, FIG. 1 is an isometric view of one form of a constructional element in accordance with the invention with portions broken away;

DESCRIPTION OF THE PREFERRED EMBODIMENT

Figure 1:
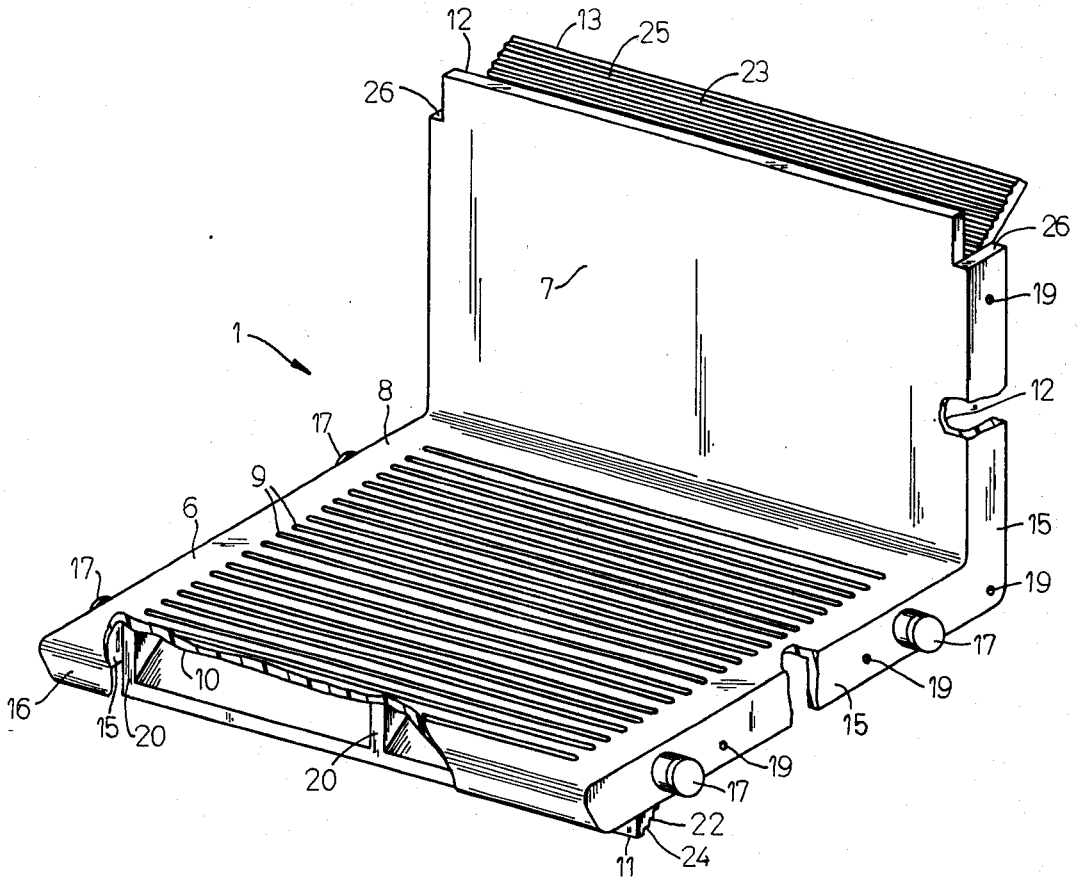
Figure 2:
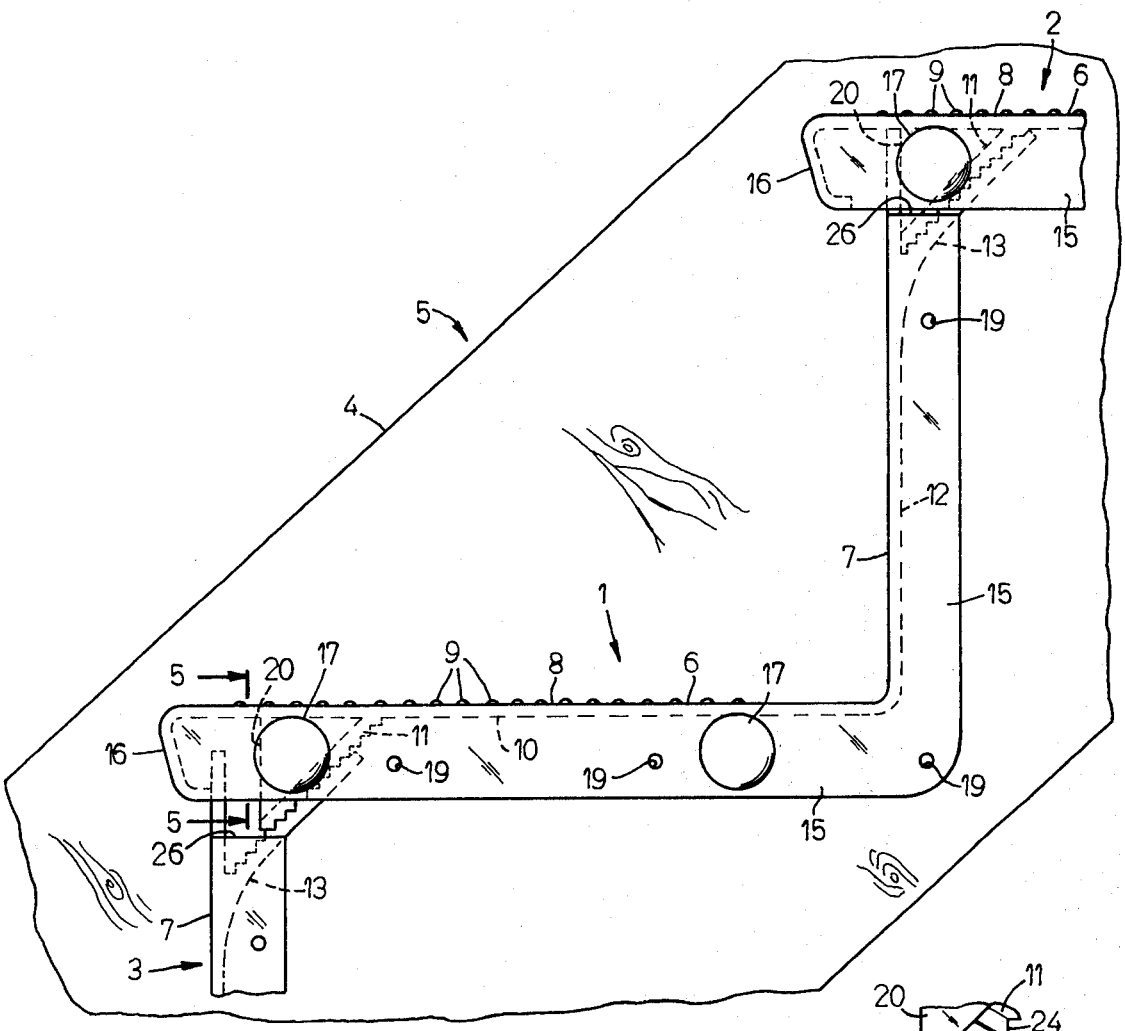
FIG. 2 is a side elevational view of the contructional element shown in FIG. 1.
Figure 3:
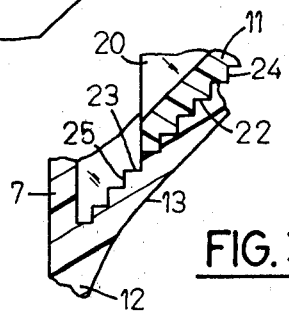
FIG. 3 is an enlarged cross-section view showing portions of the inclined stepped surfaces of the tread and riser of two associated elements.
Figure 4:
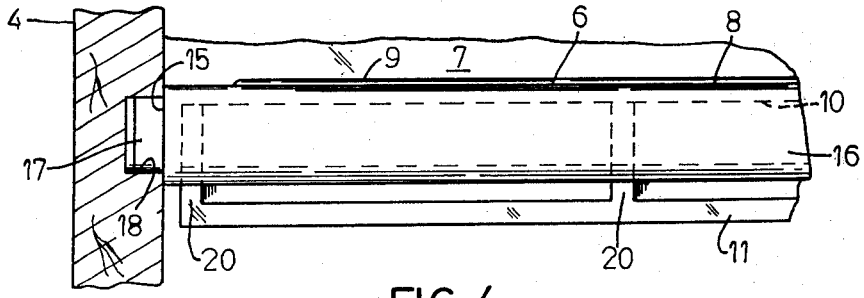
FIG. 4 is a front elevational view of a portion of the embodiment of FIGS. 1, 2 and 3.
Figure 5:
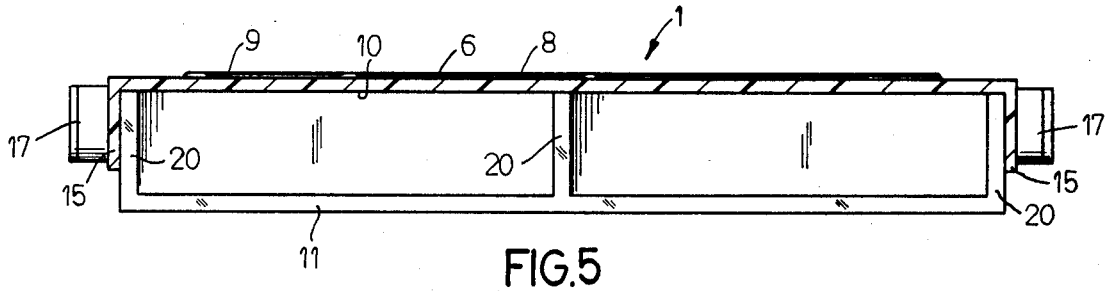
FIG. 5 is a cross-sectional view of the tread taken on line 5—5 of FIG. 2.

Referring to FIGS. 1 through 7, the numeral 1 designates a one-piece molded constructional element or unit of generally L-shaped configuration. In FIG. 2, element 1 is shown in association with two other identical elements designated 2 (upper) and 3 (lower) and the three elements 1, 2 and 3 are understood to be associated with a pair of laterally spaced apart stringers 4, only one of which is shown in FIGS. 2 and 4, to provide a complete stepped structure or staircase 5.

Element 1 comprises arms 6 and 7, extending at right angles from each other, to constitute the horizontal forwardly extending tread or go and the vertical upwardly extending riser parts, respectively, of the stepped structure 5. The upper surface 8 of tread 6 is provided with an integrally formed anti-slip design 9 molded therein, as FIG. 1 shows. The lower surface 10 of tread 6 has an integrally formed lower member 11 located near the forward extremity of the tread and projecting therefrom downwardly and toward the forward or front edge of the tread. The rear surface 12 of riser 7 has an integrally formed upper member 13 located near the upper extremity of the riser and projecting therefrom rearwardly and toward the top end or edge of the riser. The projecting member 11 and 13 are hereinafter described in more detail.

The tread 6 and riser 7 and the upper projecting member 13 are strengthened by a pair of integrally formed outermost webs 15 located at opposite extreme sides of the element 1 and each web 15 extends around the arms 6 and 7 from upper member 13 to a front depending web 16 located at the front extremity or edge of the tread 6. A pair of integrally formed cylindrical projections 17 are provided on the outer side of and extend laterally from each outermost web 15. The projections 17 are inserted into appropriately positioned holes 18 in the stringers 4 to provide a finished stepped structure 5 and serve a load-bearing as well as a positioning function. In addition the outermost webs 15 are provided with a plurality of holes 19 for accommodating screws or the like to fix the element 1 securely to the stringers 4.

The lower projecting member 11 is strengthened by three integrally formed webs 20 which extend between member 11 and the lower surface 10 of tread 6.

Figure 7:
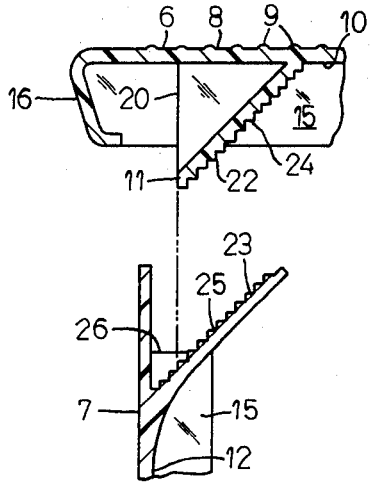
FIG. 7 is a cross-sectional view showing the tread spaced from a riser therebeneath, as during assembly.

As FIGS. 3 and 7 show, the inclined projecting members 11 and 13 are provided with inclined surfaces 22 and 23, respectively, which surfaces are provided with steps 24 and 25, respectively. When two elements such as 1 and 2 or 1 and 3 are assembled together, the stepped inclined surface 22 of one element interlocks with the mating stepped surface 23 of the next adjacent element. A preferred size for each step 24 and 25 is 1 mm in the vertical direction and 1 mm in the horizontal direction thereby enabling a very close adjustment of the relative positions of adjacent interconnected elements such as 1. The pitch angle, which is constant irrespective of the adjusted relative positions of the construction elements is preferably about 41°. FIG. 2 shows, for purposes of illustration, that elements 1 and 2 are adjusted differently than elements 1 and 3.

Figure 6:
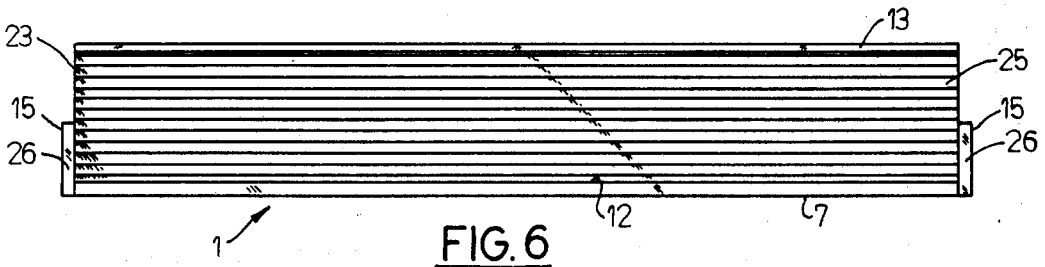
FIG. 6 is a top plan view of the riser.

In order for elements such as 1 to fit together properly, it is necessary to provide cutouts or notches 26, shown in FIGS. 1 and 6, at the upper extreme corners of the riser 7 to enable it to fit under the tread 6 between the outermost webs 15 of an adjacent element.

Figure 8:
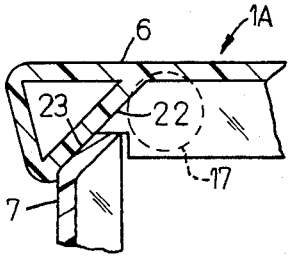
FIG. 8 is a cross-sectional view of a portion of an alternative to the embodiment shown in FIGS. 1 through 7.

Referring to FIG. 8 a different molded form of constructional unit, designated 1A, is shown with the inclined stepped mating surfaces 22 and 23 being closer to the extreme edges of the respective tread 6 and riser 7. This tends to center the load of a person climbing the stepped structure more directly over the vertically disposed riser 7. It will, however, be appreciated that both embodiments direct the downward loads involved through the inclined surfaces 22 and 23 to the very strong structural arrangement of the vertically arranged webs and riser 7. Thus once the adjusted relative positions of the elements are decided upon and the projections 17 fixed in the appropriate holes 18 in the stringers 4 and the screws screwed through the screwholes 19 into the stringers 4, a strong rigid but comparatively light stepped structure 5 is formed.

In a preferred embodiment of the invention the element 1 is molded from high density foamed polystyrene. Additives may be incorporated in the polystyrene material to give it a fire resistant property. Alternatively, the elements may be made from polyvinyl chloride which has inherent fire resistant properties, or other suitable synthetic plastics material. The plastics material may be solid or foamed. In a further modified form of the invention, the constructional element may be molded from metal such as aluminum or a zinc alloy.

It will be appreciated that the above embodiments are described by way of example only and that many variations are possible without departing from the scope of the invention.

What is claimed is:

1. An adjustable step unit for assembly with at least one similar unit and a pair of laterally spaced apart stringers disposed along the sides of said unit to form a staircase whose height and length can be varied without changing the pitch angle of the staircase, comprising:

a horizontal tread comprising upper and lower surfaces and front and rear edges;

a vertical riser comprising front and rear surfaces and upper and lower edges;

said riser having its lower edge joined to the rear edge of said tread and extending upwardly therefrom;

a first member joined to the rear surface of said riser near the upper edge thereof and extending upwardly and rearwardly from said rear surface, said first member having an inclined upwardly facing surface with a plurality of first slots formed thereon;

a second member joined to the lower surface of said tread near the front edge thereof and extending downwardly and forwardly from said lower surface, said second member having an inclined downwardly facing surface with a plurality of second slots formed thereon for locking engagement in one of a plurality of different positions with the first slots on a similar step unit in a staircase;

and means at the sides of said unit for securing said unit to said stringers of said staircase.

2. A unit according to claim 1 wherein said means comprises projections extending outwardly near said tread.

3. A unit according to claim 1 wherein said means comprises mounting holes formed in aid unit.

4. An adjustable step unit for assembly with at least one similar unit and a pair of laterally spaced apart stringers disposed along the sides of said unit to form a staircase whose height and length can be varied without changing the pitch angle of the staircase, comprising:

a horizontal tread comprising upper and lower surfaces, front and rear edges, and side edges;

a vertical riser comprising front and rear surfaces, upper and lower edges, and side edges;

said riser having its lower edge joined to the rear edge of said tread and extending upwardly therefrom;

a downwardly depending web at the front edge of said tread;

a first member joined to the rear surface of said riser near the upper edge thereof and extending upwardly and rearwardly from said rear surface, said first member having an inclined upwardly facing surface with a plurality of first laterally extending parallel slots formed thereon;

a second member joined to the lower surface of said tread near the front edge thereof and extending downwardly and forwardly from said lower surface, said second member having an inclined downwardly facing surface with a plurality of second laterally extending parallel slots formed thereon for locking engagement in one of a plurality of different positions with the first slots on a similar step unit in a staircase;

first web means connected along the side edges of said tread and said riser between said first member and said downwardly depending web to strengthen said tread, riser and first member;

second web means connected between said second member and said tread to strengthen said second member;

and means at the sides of said unit for securing said unit to said stringers of said staircase.

5. A unit according to claim 4 wherein said means comprises projections extending outwardly of said first web means alongside said tread.

6. A unit according to claim 5 wherein said means further comprises mounting holes through said first web.

* * * * *